US008469721B2

(12) United States Patent
Mitchell et al.

(10) Patent No.: US 8,469,721 B2
(45) Date of Patent: Jun. 25, 2013

(54) CUSTOMIZABLE POWER UTILITY CONNECTORS AND METHODS AND CONNECTIONS INCLUDING SAME

(75) Inventors: Steve Mitchell, Thompsons Station, TN (US); Owen Gregory, Apex, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 146 days.

(21) Appl. No.: 13/177,325

(22) Filed: Jul. 6, 2011

(65) Prior Publication Data

US 2013/0012075 A1 Jan. 10, 2013

(51) Int. Cl.
*H01R 4/50* (2006.01)

(52) U.S. Cl.
USPC ..... 439/66

(58) Field of Classification Search
USPC ..... 439/783, 762, 863, 775, 758, 781, 439/790–794; 29/751
See application file for complete search history.

(56) References Cited

U.S. PATENT DOCUMENTS

| | | | | |
|---|---|---|---|---|
| 1,278,785 | A * | 9/1918 | Tainter | 403/391 |
| 5,911,604 | A * | 6/1999 | Chadbourne | 439/783 |
| 6,120,334 | A | 9/2000 | Timsit et al. | |
| 6,517,391 | B1 | 2/2003 | Chadbourne | |
| 7,182,653 | B1 * | 2/2007 | Hoxha | 439/783 |
| 7,309,263 | B2 | 12/2007 | Copper et al. | |
| 7,387,546 | B2 | 6/2008 | Copper et al. | |
| 7,426,782 | B2 | 9/2008 | Johnson et al. | |
| 7,494,385 | B2 | 2/2009 | Copper et al. | |
| 7,524,217 | B2 | 4/2009 | Copper et al. | |
| D599,184 | S | 9/2009 | Johnson et al. | |
| 7,677,933 | B2 | 3/2010 | Copper et al. | |
| 7,686,661 | B2 | 3/2010 | Shrum et al. | |
| 7,736,203 | B2 | 6/2010 | Copper et al. | |

(Continued)

FOREIGN PATENT DOCUMENTS

FR 2 762 449 A1 10/1998

OTHER PUBLICATIONS

"Copper ShearBolt Connectors" Tyco Electronics Corporation, Issued 2004-2005, http://energy.tycoelectronics.com, 1 page.

(Continued)

*Primary Examiner* — Jean F Duverne
(74) *Attorney, Agent, or Firm* — Myers Bigel Sibley & Sajovec, PA

(57) ABSTRACT

A transverse wedge connector system for forming an electrical connection with first and second elongate electrical conductors includes an electrically conductive first connector member, an electrically conductive second connector member, an insert member, and a clamping mechanism. The first connector member includes a first body having a first channel portion and a first abutment portion. The first channel portion defines a first channel to receive the first conductor. The second connector member includes a second body having a second channel portion and a second abutment portion. The second channel portion defines a second channel to receive the second conductor. The insert member is configured to be selectively mounted in the first channel and defining an insert member channel to receive the first conductor when the insert member is mounted in the first channel. The clamping mechanism is selectively operable to displace the first and second connector members relative to one another from an open position to a closed position to clamp the first conductor between the first channel portion and the second abutment surface, and to clamp the second conductor between the second channel portion and the first abutment portion to thereby form a connection.

21 Claims, 7 Drawing Sheets

U.S. PATENT DOCUMENTS

| | | | | |
|---|---|---|---|---|
| 7,819,706 | B2 | 10/2010 | Copper et al. | |
| 7,845,990 | B2 * | 12/2010 | Shrum et al. | 439/781 |
| 7,862,390 | B2 * | 1/2011 | Copper | 439/781 |
| 2010/0011571 | A1 | 1/2010 | Copper et al. | |
| 2010/0015862 | A1 | 1/2010 | Gregrory et al. | |
| 2010/0227512 | A1 | 9/2010 | Copper et al. | |
| 2011/0028052 | A1 | 2/2011 | Copper et al. | |

OTHER PUBLICATIONS

Notification of Transmittal of the International Search Report and the Written Opinion of the International Searching Authority, or the Declaration in corresponding PCT Application No. PCT/US2012/045233 mailed Oct. 2, 2012 (16 pages).

* cited by examiner

CUSTOMIZABLE POWER UTILITY CONNECTORS AND METHODS AND CONNECTIONS INCLUDING SAME

FIELD OF THE INVENTION

The present invention relates to electrical connectors and, more particularly, to power utility electrical connectors and methods and connections including the same.

BACKGROUND OF THE INVENTION

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, four types of connectors are commonly used for such purposes, namely bolt-on connectors, compression-type connectors, wedge connectors, and transverse wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors.

Compression connectors, instead of utilizing separate connector pieces, may include a single metal piece connector that is bent or deformed around the main power conductor and the tap conductor to clamp them to one another.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from TE Connectivity and is known as an AMPACT Tap or Stirrup Connector. AMPACT connectors include different sized channel members to accommodate a set range of conductor sizes, and multiple wedge sizes for each channel member. Each wedge accommodates a different conductor size.

Exemplary transverse wedge connectors are disclosed in U.S. Pat. Nos. 7,862,390, 7,845,990, 7,686,661, 7,677,933, 7,494,385, 7,387,546, 7,309,263, 7,182,653 and U.S. Patent Publication Nos. 2010/0015862 and 2010/0011571.

One such transverse wedge connector is commercially available from TE Connectivity.

SUMMARY OF THE INVENTION

According to embodiments of the present invention, a transverse wedge connector system for forming an electrical connection with first and second elongate electrical conductors includes an electrically conductive first connector member, an electrically conductive second connector member, an insert member, and a clamping mechanism. The first connector member includes a first body having a first channel portion and a first abutment portion. The first channel portion defines a first channel to receive the first conductor. The second connector member includes a second body having a second channel portion and a second abutment portion. The second channel portion defines a second channel to receive the second conductor. The insert member is configured to be selectively mounted in the first channel and defining an insert member channel to receive the first conductor when the insert member is mounted in the first channel. The clamping mechanism is selectively operable to displace the first and second connector members relative to one another from an open position to a closed position to clamp the first conductor between the first channel portion and the second abutment surface, and to clamp the second conductor between the second channel portion and the first abutment portion to thereby form a connection.

According to method embodiments of the present invention, a method for forming a connection including first and second elongate electrical conductors includes providing a transverse wedge connector system. The connector system includes an electrically conductive first connector member, an electrically conductive second connector member, an insert member, and a clamping mechanism. The first connector member includes a first body having a first channel portion and a first abutment portion. The first channel portion defines a first channel to receive the first conductor. The second connector member includes a second body having a second channel portion and a second abutment portion. The second channel portion defines a second channel to receive the second conductor. The insert member is configured to be selectively mounted in the first channel and defining an insert member channel to receive the first conductor when the insert member is mounted in the first channel. The method further includes: with the first and second connector members in an open position, placing the first conductor in the first channel or, alternatively, in the insert member channel with the insert member mounted in the first channel; and thereafter selectively operating the clamping mechanism to displace the first and second connector members relative to one another from the open position to a closed position to clamp the first conductor between the first channel portion and the second abutment surface, and to clamp the second conductor between the second channel portion and the first abutment portion to thereby form a connection.

According to embodiments of the present invention, a connector system for forming an electrical connection with an elongate electrical conductor includes an electrically conductive connector member, an insert member and a clamping mechanism. The connector member includes a body having a channel portion defining a first channel to receive the conductor. The insert member is configured to be selectively mounted in the first channel and defines an insert member channel to receive the conductor when the insert member is mounted in the first channel. The clamping mechanism is selectively operable to secure the conductor in the first channel or in the insert member channel to thereby form a connection. The first channel defines a first channel longitudinal axis. The insert member channel defines an insert member channel longitudinal axis. The first channel has a longitudinally extending side opening that permits insertion of the first conductor into the first channel in an insertion direction transverse to the first channel longitudinal axis. The insert member channel has a longitudinally extending side opening that permits insertion of the first conductor into the insert member channel in an insertion direction transverse to the insert member channel longitudinal axis.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
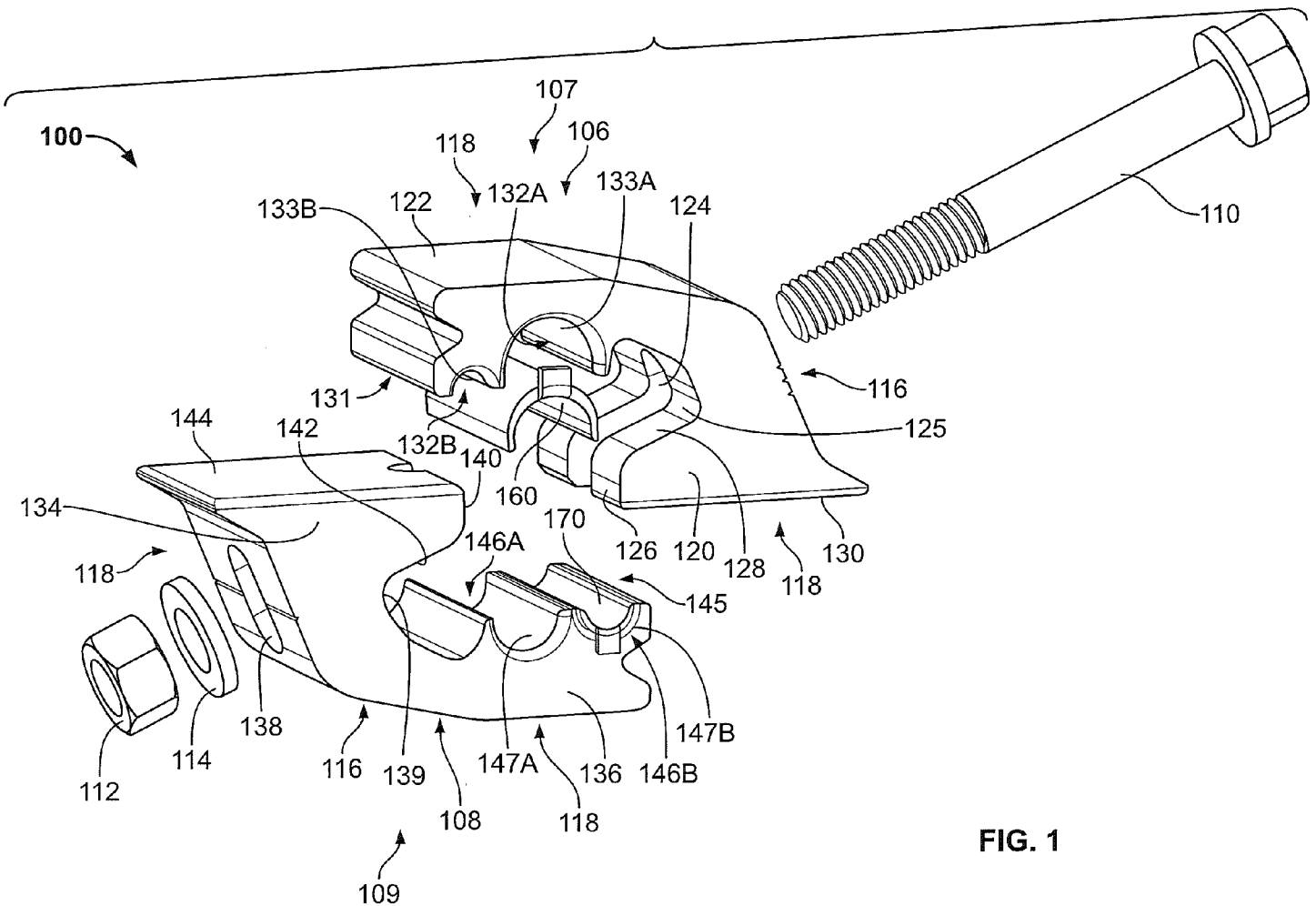
FIG. 1 is an exploded, perspective view of a transverse wedge connector assembly according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this disclosure and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-10, a transverse wedge connector assembly 100 according to embodiments of the present invention is shown therein. The connector assembly 100 can be used to form a connection 5 (FIG. 9) including a pair of elongate electrical conductors 12, 14 (e.g., electrical power lines) mechanically and electrically coupled by the connector assembly 100. The connector assembly 100 may be adapted for use as a tap connector for connecting an elongate tap conductor 12 to an elongate main conductor 14 of a utility power distribution system, for example. The connector assembly 100 can be customized to accommodate different sizes of elongate conductors.

The tap conductor 12, sometimes referred to as a distribution conductor, may be a known electrically conductive metal high voltage cable or line having a generally cylindrical form in an exemplary embodiment. The main conductor 14 may also be a generally cylindrical high voltage cable line. The tap conductor 12 and the main conductor 14 may be of the same wire gage or different wire gage in different applications and the connector assembly 100 is adapted to accommodate a range of wire gages for each of the tap conductor 12 and the main conductor 14.

When installed to the tap conductor 12 and the main conductor 14, the connector assembly 100 provides electrical connectivity between the main conductor 14 and the tap conductor 12 to feed electrical power from the main conductor 14 to the tap conductor 12 in, for example, an electrical utility power distribution system. The power distribution system may include a number of main conductors 14 of the same or different wire gage, and a number of tap conductors 12 of the same or different wire gage. The connector assembly 100 may be used to provide tap connections between main conductors 14 and tap conductors 12 in the manner explained below.

With reference to FIG. 1, the connector assembly 100 includes a first connector member 106, a second connector member 108, a first insert member 160, a second insert member 170, and a clamping mechanism or fastener 110 that couples the first connector member 106 and the second connector member 108 to one another. Generally described, the first insert member 160 is mounted on the first connector member 106 to form, collectively, a first connector member assembly 107, and the second insert member 170 is mounted on the second connector member 108 to form, collectively, a second connector member assembly 109. In use, the first connector member assembly 107 and the second connector member assembly 109 are coupled and clamped together by the fastener 110.

The conductor assembly 100 can be selectively employed and, in some cases, reconfigured to accommodate or better accommodate conductors 12, 14 of different sizes. That is, the connector assembly 100 and connector assemblies constructed from connector systems according to embodiments of the present invention can be conveniently customized to fit different sized elongate conductors 12, 14.

In the illustrated embodiment, the fastener 110 is a threaded member inserted through the respective connector members 106 and 108, and a nut 112 and lock washer 114 are provided to engage an end of the fastener 110 when the connector members 106 and 108 are assembled. While specific fastener elements 110, 112 and 114 are illustrated in FIG. 1, it is understood that other known or suitable fasteners or clamping mechanisms may alternatively be used.

Each of the connector members 106, 108 generally includes a central body portion 116 and arms 118 that extend outward from the body portion 116. Optionally, the arms 118 may be substantially identically formed, however, in the illustrated embodiment, the arms 118 are differently sized and shaped.

The first connector member 106 includes a wedge portion 120 and a channel portion 122 extending from the wedge portion 120. The channel portion 122 defines a first of the arms 118 and the wedge portion 120 defines a second of the arms 118 for the first connector member 106. A fastener bore 124 is formed in and extends through at least a portion of the body portion 116. The fastener bore 124 may also be formed in and extend through at least a portion of the wedge portion 120. The body portion 116 also defines a displacement stop 125 proximate the wedge portion 120. The second connector member 108 engages the displacement stop 125 when the connector assembly is fully assembled, as described in further detail below.

The wedge portion 120 includes an abutment face 126, a wiping contact surface 128, and a conductor contact surface 130. The wiping contact surface 128 is angled with respect to the abutment face 126 and a rounded edge may define a transition between the abutment face 126 and the wiping contact surface 128. The conductor contact surface 130 extends substantially perpendicular to the abutment face 126 and obliquely with respect to the wiping contact surface 128. The conductor contact surface 130 generally faces a portion of the second connector member 108 and engages and captures the main conductor 14 therebetween during assembly of the connector assembly 100. The conductor contact surface 130 may be substantially flat or planar.

The channel portion 122 extends away from the wedge portion 120 and includes a mating interface 131 that generally faces the wedge portion 120. The channel portion 122 includes seat surfaces 133A and 133B defining an arcuate, concave (e.g., semi-cylindrical) large channel 132A and an arcuate, concave small channel 132B, respectively, positioned along the mating interface 131. The channels 132A, 132B are each adapted to receive an elongate conductor at a spaced relation from the wedge portion 120. The channel portion 122 may be generally hook-shaped, and the wedge portion 120 and the channel portion 122 together have a generally J-shaped or C-shaped body. The channels 132A and 132B have longitudinally extending side openings 135A and 135B (FIG. 2), respectively.

The channels 132A, 132B are sized and shaped to cradle an elongate conductor and hold the conductor in position during assembly of the connector assembly 100. In an exemplary embodiment, the channels 132A, 132B are sized and/or shaped differently than one another to accommodate different sized and/or shaped elongate conductors. Each channel 132A, 132B includes an open side that receives the elongate conductor and exposes at least a portion of the elongate conductor. For example, the channel seat surfaces 133A, 133B may wrap around the elongate conductor for about 180 circumferential degrees in an exemplary embodiment, and may expose about 180 circumferential degrees of the tap elongate conductor. The open side of each channel 132A, 132B lies along the mating interface 131 and generally faces toward the wedge portion 120.

The second connector member 108 likewise includes a wedge portion 134 and a channel portion 136 extending from the wedge portion 134. The channel portion 136 defines a first of the arms 118 and the wedge portion 134 defines a second of the arms 118 for the second connector member 108. A fastener bore 138 is formed in and extends through at least a portion of the body portion 116. The fastener bore 138 may also be formed in and extend through at least a portion of wedge portion 134. The body portion 116 also defines a displacement stop 139 proximate the wedge portion 134. The wedge portion 120 of the first connector member 108 engages the displacement stop 139 when the connector assembly is fully assembled, as described in further detail below.

The wedge portion 134 includes an abutment face 140, a wiping contact surface 142, and a conductor contact surface 144. The wiping contact surface 142 is angled with respect to the abutment face 140 and a rounded edge may define a transition between the abutment face 140 and the wiping contact surface 142. The conductor contact surface 144 extends substantially perpendicular to the abutment face 140 and obliquely with respect to the wiping contact surface 142. The conductor contact surface 144 generally faces the channel portion 122 of the first connector member 106 and engages and captures the tap conductor 12 therebetween during assembly of the connector assembly 100. The conductor contact surface 144 may be substantially flat or planar.

The channel portion 136 extends away from the wedge portion 134 and includes a mating interface 145 that generally faces the wedge portions 120. The channel portion 136 includes seat surfaces 147A and 147B defining an arcuate, concave (e.g., semi-cylindrical) large channel 146A and an arcuate, concave small channel 146B, respectively, positioned along the mating interface 145. The channels 146A, 146B are adapted to receive an elongate conductor 14 at a spaced relation from the wedge portion 134. The channel portion 136 is reminiscent of a hook in one embodiment, and the wedge portion 134 and the channel portion 136 together have a generally J-shaped or C-shaped body. The channels 146A and 146B have longitudinally extending side openings (not labeled) corresponding to the side openings 135A and 135B.

Each channel 146A, 146B is sized and shaped to cradle an elongate conductor and hold the elongate conductor in position during assembly of the connector assembly 100. In an exemplary embodiment, the channels 146A, 146B are sized and/or shaped differently than one another to accommodate different sized and/or shaped elongate conductors. Each channel 146A, 146B includes an open side that receives the main elongate conductor and exposes at least a portion of the elongate conductor. For example, the seat surfaces 147A, 147B may wrap around the elongate conductor for about 180 circumferential degrees in an exemplary embodiment, and may expose about 180 circumferential degrees of the elongate conductor. The open side of each channel 146A, 146B lies along the mating interface 145 and generally faces toward the wedge portion 134.

The wedge portions 120, 134 of the respective connector members 106, 108 may be substantially identically formed and share the same geometric profile and dimensions to facilitate interfitting of the wedge portions 120, 134, in the manner explained below, as the connector members 106, 108 are mated. Identical formation of the wedge portions 120, 134 provides for mixing and matching of connector members 106, 108 for differently sized conductors 12, 14 while achieving a repeatable and reliable connecting interface via the wedge portions 120, 134. The channel portions 122, 136 of the connector members 106 and 108, however, may be differently dimensioned as appropriate to be engaged to differently sized conductors 12, 14 while maintaining substantially the same shape of the connector members 106, 108. The channel portions 122, 136 may include differently sized and/or shaped channels 132A, 132B and 146A, 146B relative to one another. Optionally, the channel portions 122, 136 may have substantially identical geometric profiles, but may include different sized and/or shaped channels 132A, 132B, 146A, 146B. Alternatively, the channel portions 122, 136 may have different geometric profiles to accommodate different sized or shaped channels 132A, 132B, 146A, 146B.

With reference to FIGS. 2-6, the insert member 160 includes a concave, inner seating or conductor engagement surface 162 and an opposing convex, outer surface 164. The conductor engagement surface 162 defines an insert member trough or channel 166. Opposed lengthwise extending edges 168 define a longitudinally extending side opening 168A of the channel 166. Opposed, arcuate end edges 167 define opposed end openings 167A of the channel 166. The side opening 168A terminates at and merges with the end openings 167A. Opposed, integral securing tabs 169 depend from respective ones of the end edges 167. The insert member 160 may have a shape that is generally C- or U-shaped in cross-section or of a truncated tube.

Figure 7:
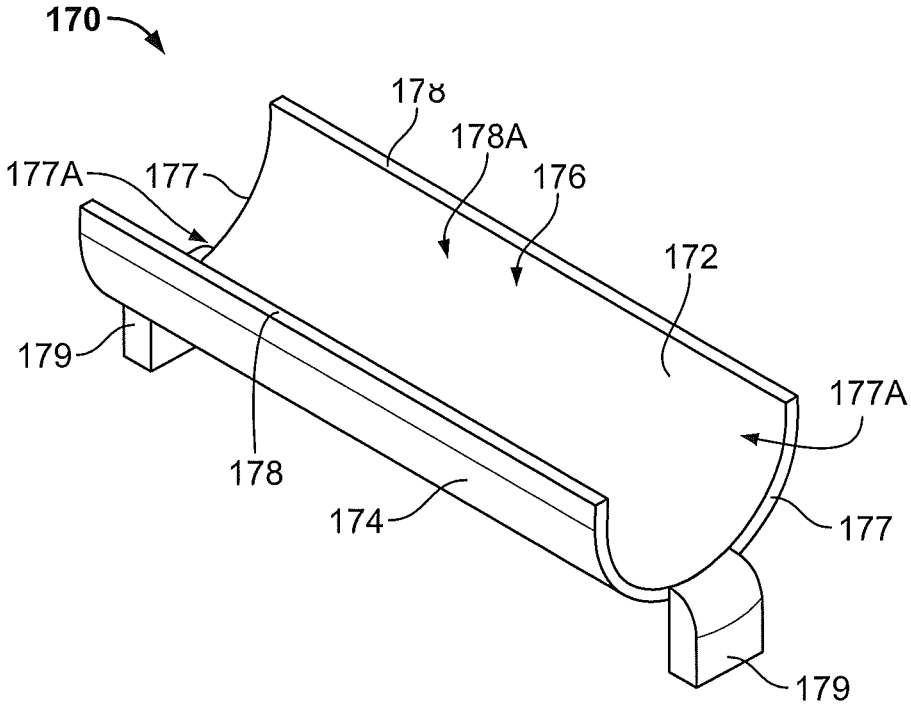
FIG. 7 is a bottom perspective view of a second insert member forming a part of the connector assembly of FIG. 1.

Similarly, with reference to FIG. 7, the insert member 170 includes a concave, inner seating or conductor engagement surface 172 and an opposing convex, outer surface 174, the conductor engagement surface 172. The conductor engagement surface 172 defines an insert member trough or channel 176, and opposed lengthwise extending edges 178 define a longitudinally extending side opening 178A of the channel 176. Opposed, arcuate end edges 177 define opposed end openings 177A of the channel 176. The side opening 178A terminates at and merges with the end openings 177A. Opposed, integral securing tabs 179 depend from respective ones of the end edges 177. The insert member 170 may have a shape that is generally C- or U-shaped in cross-section or of a truncated tube.

Figure 2:
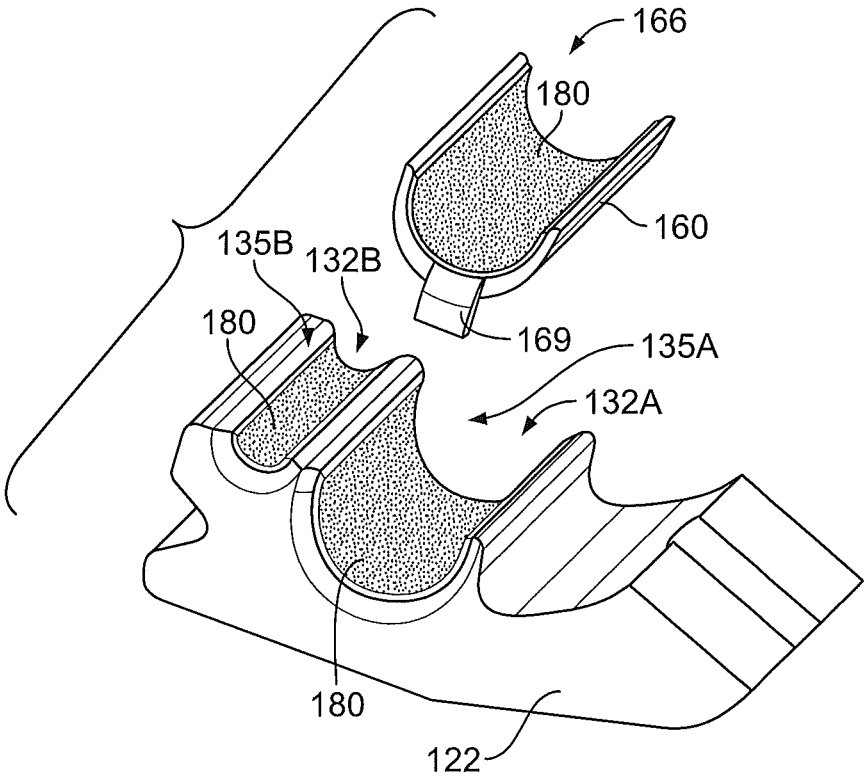
FIGS. 2 and 3 are enlarged, fragmentary, perspective views of the connector assembly of FIG. 1 illustrating mounting of an insert member in a connector member of the connector assembly.
Figure 3:
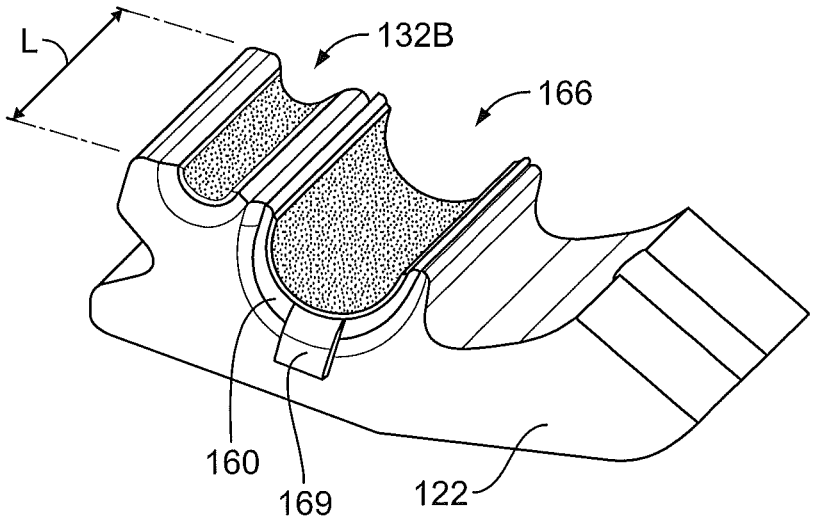
Figure 4:
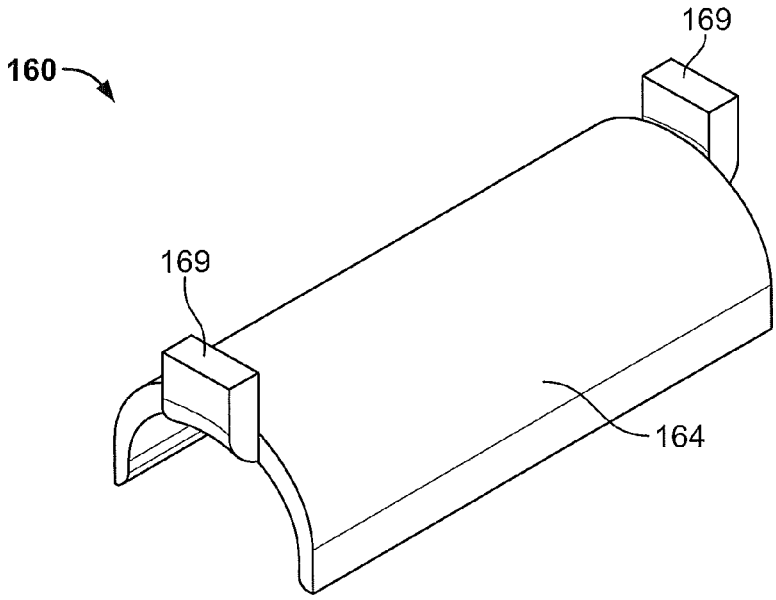
FIG. 4 is a top perspective view of the insert member of FIG. 2.
Figure 5:
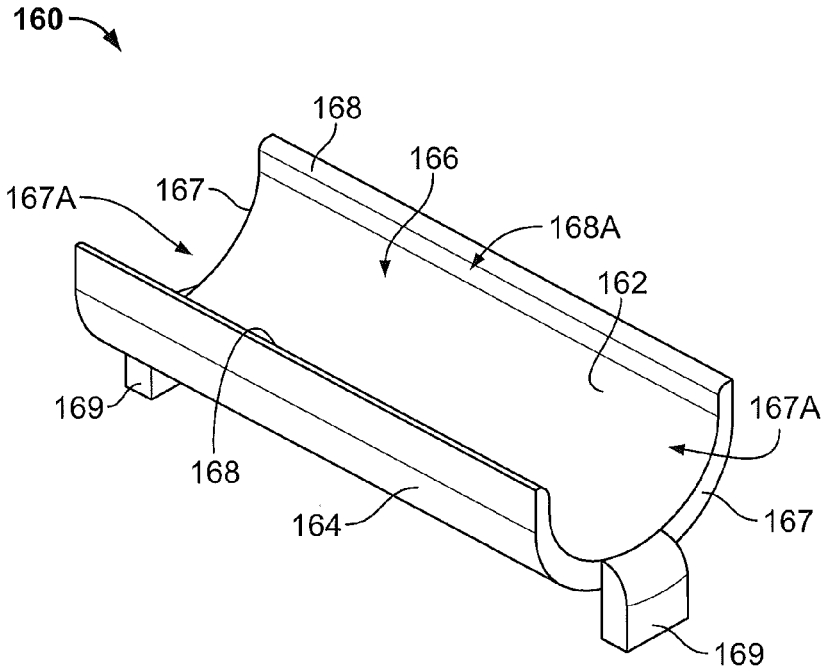
FIG. 5 is a bottom perspective view of the insert member of FIG. 2.
Figure 6:
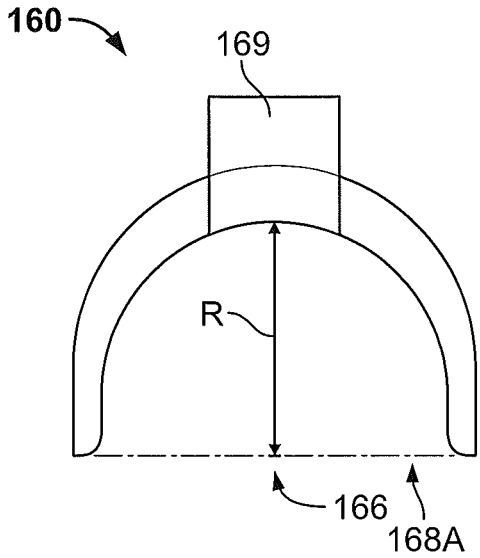
FIG. 6 is an end view of the insert member of FIG. 2.

The insert member 160 is adapted to be mounted in the channel 132A as shown in FIGS. 2 and 3 such that the insert member 160 nests within the channel 132A. According to some embodiments, the radius of curvature R (FIG. 6) of the insert member 160 is less than the corresponding radius of curvature of the channel 132A and the profile of the outer surface 164 is complementary to the profile of the surface 133A so that the insert member 160 generally conforms to the channel 132A. For example, in some embodiments, the profiles of the surfaces 133A, 164 are each laterally truncated cylindrical (i.e., semi-circular in cross-section) as illustrated.

The insert member 160 is removably retained in the channel 132A by the securing tabs 169. The securing tabs 169 overlap the opposed side faces of the channel portion 136. The securing tabs 169 may be bent or shaped to provide a persistent compression load to the channel portion 136 to thereby create an interference fit between the securing tabs 169 and the channel portion 136 sufficient to retain the insert member 160 in the channel 132A unless and until a deliberate removal force is applied to the insert member 160.

According to some embodiments, the insert member 160 is pre-formed such that the distance between the securing tabs 169 in their relaxed state is less than the width between the opposed faces of the channel portion 136 so that, when the insert member 160 is forced onto the channel portion 136, the securing tabs 169 are outwardly elastically deflected. As a result, the securing tabs 169 provide a spring bias tending to maintain the aforedescribed interference fit.

According to some embodiments, the insert member 160 is pre-installed in the channel 132A in the factory. However, according to some embodiments, the insert member 160 may be installed in the channel 132A in the field by an installer, for example.

The insert member 170 is mounted in and relates to the channel 146B in the same manner as described above for the insert member 160 and the channel 132A. The insert member 170 is likewise removably retained in the channel 146B by the securing tabs 179.

The channels 166, 176 are sized and shaped to cradle an elongate conductor (e.g., the conductor 12 or 14) and hold the conductor in position during assembly of the connector assembly 100. The channels 166, 176 are smaller than (and may be shaped differently than) the channels 132A, 146B to accommodate smaller sized elongate conductors than the channels 132A, 146B. Each channel 166, 176 includes an open side that receives the elongate conductor and exposes at least a portion of the elongate conductor. For example, the channel seat surfaces 162, 172 may wrap around the elongate conductor for about 180 circumferential degrees in an exemplary embodiment, and may expose about 180 circumferential degrees of the tap elongate conductor. The open side of each channel 166, 176 lies along the mating interface 131 and generally faces toward the wedge portion 120.

The insert member contact surfaces 162, 172 and the channel surfaces 133A, 133B, 147A, 147B may be coated with layers of a corrosion inhibitor material 180. The corrosion inhibitor material 180 may be a flowable, viscous material. The corrosion inhibitor material 180 may be, for example, a base oil with metal particles suspended therein. In some embodiments, the corrosion inhibitor 180 is a cod oil derivative with aluminum nickel alloy particles. Suitable inhibitor materials are available from TE Connectivity. The layers of a corrosion inhibitor material 180 may include layers interposed between the insert members 160, 170 and the surfaces 133A, 147B. According to some embodiments, the layers 180 each have a thickness in the range of from about 0.02 to 0.03 inch.

According to some embodiments, the first connector member 106, the second connector member 108, the insert member 160 and the insert member 170 are separately fabricated from one another or otherwise formed into discrete connector components and are assembled to one another as explained below. While exemplary shapes of the connector members 106, 108 and the insert members 160, 170 have been described herein, it is recognized that the connector members 106, 108 and the insert members 160, 170 may be alternatively shaped in other embodiments as desired.

The connector members 106, 108 may be formed of any suitable electrically conductive material. According to some embodiments, the connector members 106, 108 are formed of metal. According to some embodiments, the connector members 106, 108 are formed of aluminum or steel. According to some embodiments, the connector members 106, 108 are formed of aluminum alloy 6061 heat treated in T6 condition. The connector members 106, 108 may be formed using any suitable technique. According to some embodiments, each of the connector members 106, 108 is monolithic and unitarily formed. According to some embodiments, the connector members 106, 108 are extruded and cut. Alternatively or additionally, the connector members 106, 108 may be stamped (e.g., die-cut), cast and/or machined. Because the connector members 106, 108 are identically configured, only one configuration needs to be produced.

The insert members 160, 170 may be formed of any suitable material. According to some embodiments, the insert members 160, 170 are formed of an electrically conductive material. According to some embodiments, the insert members 160, 170 are formed of metal. According to some embodiments, the insert members 160, 170 are formed of aluminum or steel. According to some embodiments, the insert members 160, 170 are formed of aluminum alloy 6061 heat treated in T6 condition. The insert members 160, 170 may be formed using any suitable technique. According to some embodiments, each of the insert members 160, 170 is monolithic and unitarily formed. According to some embodiments, the insert members 160, 170 are extruded and cut. Alternatively or additionally, the insert members 160, 170 may be stamped (e.g., die-cut), cast and/or machined.

As discussed in more detail below, the conductors 12, 14 can be clamped in selected ones of the channels 132A, 132B, 146A, 146B, 166, 176, depending on the sizes of the conductors 12, 14 to be connected. The installer can elect to place an elongate conductor in the channel 132B, in the channel 166 (with the insert member 160 mounted in the channel 132A), or in the channel 132A (with the insert member 160 removed from the channel 132A). Likewise, the installer can elect to place an elongate conductor in the channel 146A, in the channel 176 (with the insert member 170 mounted in the channel 146B), or in the channel 146B (with the insert member 170 removed from the channel 146B). Each insert member 160, 170 serves as a spacer that reduces the effective depth, volume and/or size of the channel 132A, 146B within which it is mounted.

According to embodiments of the invention, the channels 132A, 132B and 166 are each different from one another in cross-sectional size and/or shape so that they are each sized or configured to accommodate a different size elongate conductor or elongate conductors in a different range of diameters. Likewise, according to embodiments of the invention, the channels 146A, 146B and 176 are each different from one another in cross-sectional size and/or shape so that they are each sized or configured to accommodate a different size elongate conductor or elongate conductors in a different range of diameters.

Figure 9:
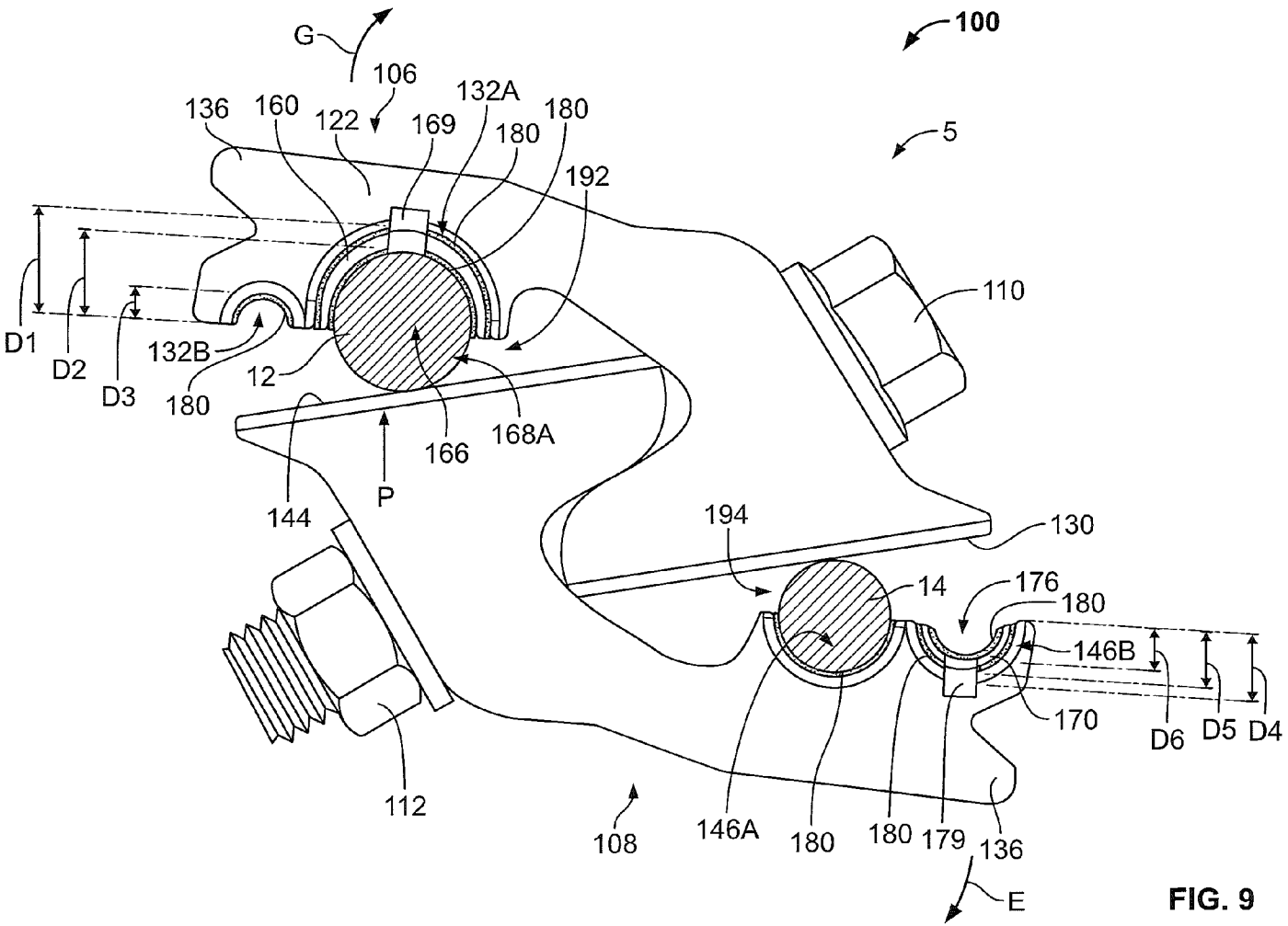
FIG. 9 is a side view of the connector assembly of FIG. 1 fully installed on the first and second conductors of FIG. 8 to form of connection.

With reference to FIG. 9, the channel 132A has a depth D1, the channel 132B has a depth D2, the channel 166 has a depth D3, the channel 147A has a depth D4, the channel 147B has a depth D5, and the channel 176 has a depth D6, each of the depths being measured from the mating interface 131 when the connector assembly 100 is closed. According to some embodiments, the depths D1, D2 and D3 are each different from one another. According to some embodiments and as illustrated, the depth D1 is greater than the depth D3, which is greater than the depth D2. Likewise, according to some embodiments, the depths D4, D5 and D6 are each different from one another. And, according to some embodiments and as illustrated, the depth D4 is greater than the depth D6, which is greater than the depth D5. Typically, the diameter of the conductor 12, 14 seated in a selected channel will be greater than the depth of the channel so that the conductor extends or is exposed beyond the mating surface 131, 145.

In the case where, as illustrated, the channels are generally arcuate, their respective radii of curvature are related in the same manner as the depths D1-D6. However, the channels may have cross-sectional shapes of other configurations. Moreover, the channels may differ in cross-sectional size as described above while having the same depths but differing widths, for example.

Each channel 132A, 132B, 146A, 146B, 166, 176 may accommodate a range of elongate conductor sizes. The range of conductors accommodated by a given one of the channels 132A, 132B, 146A, 146B, 166, 176 may depend on the cross-sectional area of the channel, the radius of curvature of the channel, the depth of the channel, the diameter of the conductor, the cross-sectional shape of the conductor, the type of conductor, or other factors.

Figure 8:
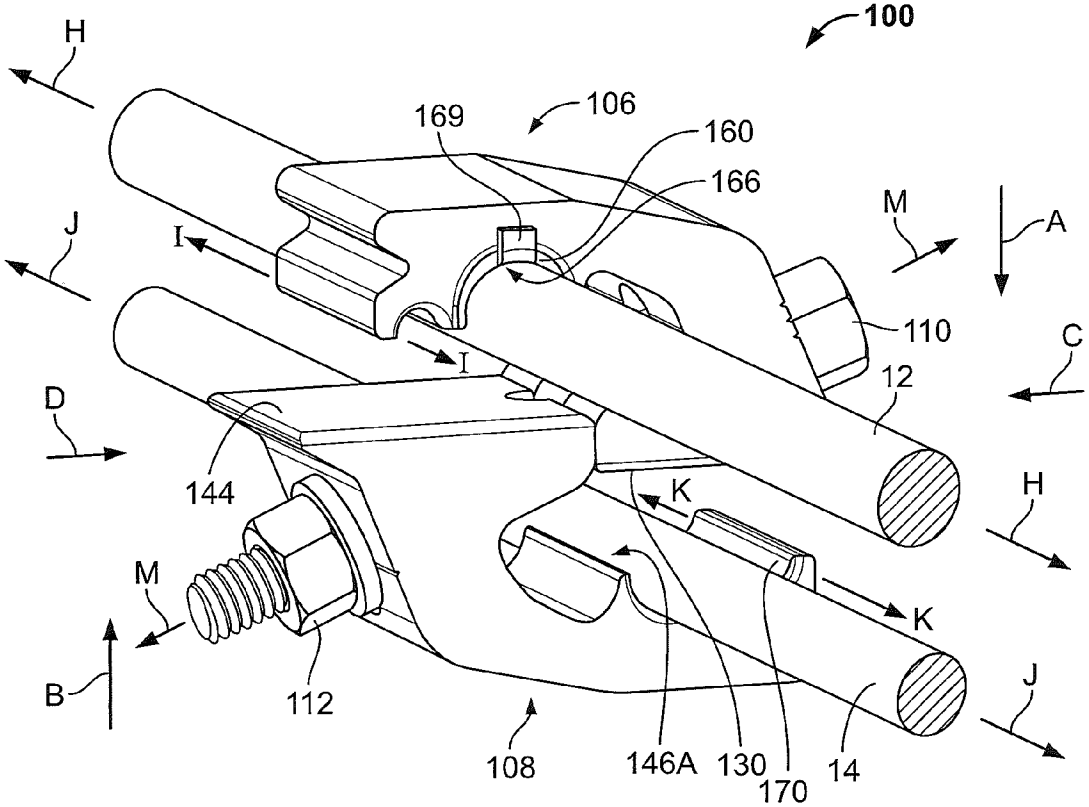
FIG. 8 is a perspective view of the connector assembly of FIG. 1 partially installed on first and second elongate conductors.

With reference to FIGS. 1, 8 and 9, exemplary methods for assembling and using the connector assembly 100 in accordance with embodiments of the present invention will now be described. For the purpose of illustration, the methods will initially be described with reference to the connector assembly configured as illustrated in FIG. 1. However, as explained below, additional configurations or combinations of components may be provided or enabled.

The installer determines the size (e.g., the diameter or gauge) of the elongate conductor 12 and then determines which of the channels 132A, 132B, 166 is of the appropriate corresponding or prescribed channel size to receive an elongate conductor of this size. If the channel 132B or the channel 166 is selected, the conductor 12 is mounted in the selected channel 132B, 166. If the channel 132A is selected, the insert member 160 is removed from the channel 132A and the conductor 12 is mounted directly in the channel 132A. The insert member 160 may be removed from the channel 132A by pulling or prying the insert member 160 away with a tool such as a screwdriver or pliers, for example. In the method illustrated in FIGS. 8 and 9, the channel 166 of the insert member 160 is selected for receiving the conductor 12.

Similarly, the installer determines the size (e.g., the diameter or gauge) of the elongate conductor 14 and then determines which of the channels 146A, 146B, 176 is of the appropriate corresponding or prescribed channel size to receive an elongate conductor of this size. If the channel 146A or 176 is selected, the conductor 14 is mounted in the selected channel 146A, 176. If the channel 146B is selected, the insert member 170 is removed from the channel 146B and the conductor 14 is mounted directly in the channel 146B. In the method illustrated in FIGS. 8 and 9, the channel 146A is selected for receiving the conductor 14.

While securing tabs 169, 179 are described herein for removably securing the insert members 160, 170 in the channels of the connector members 106, 108, alternative or supplemental retention features or mechanisms may be used. For example, features (e.g., detents) may be provided in the connector members 106, 108 to cooperate with the securing tabs 169, 179. According to some embodiments, the insert members are releasably or permanently held in the channels by a layer of an adhesive, mastic or other coating. For example, the inhibitor 180 may provide sufficient adhesion to releasably secure the insert members 160, 170 in the channels 132A, 146B.

As shown in FIG. 1, prior to assembly, the first connector member 106 and the second connector member 108 are generally inverted relative to one another with the respective wedge portions 120, 134 facing one another. The fastener bores 124, 138 are aligned with one another to facilitate extension of the fastener 110 therethrough. The channel portion 122 of the first connector member 106 extends away from the wedge portion 120 in a first direction and the channel portion 136 of the second connector member 108 extends from the wedge portion 134 in a second, opposite direction. Additionally, the channel portion 122 of the first connector member 126 extends around the conductor 12 in a first circumferential direction, while the channel portion 136 of the second connector member 108 extends circumferentially around the conductor 14 in a second, opposite direction.

During assembly, when the conductors 12, 14 are placed in, and cradled by, the respective channel portions 122, 136, and when the connector members 106, 108 are coupled together by the fastener elements 110, 112, 114, the abutment faces 126, 140 are aligned in an unmated condition as shown in FIG. 8. The connector assembly 100 may be preassembled into the configuration shown in FIG. 8, and the conductors 12 and 14 may be positioned within respective ones of the channels 166 and 146A relatively easily. Because the openings of the fastener bores 114, 138 are larger than an outer diameter of the fastener 110, the fastener 110 is positionable in a first angular orientation through the wedge portions 120 and 134.

The fastener 110 is then rotated to tighten the fastener 110 about the connector members 106, 108. The relative size of the fastener bores 124, 138 with respect to the fastener 110 permits the fastener 110 to float or move angularly with respect to an axis of the bores 124, 138 as the connector members 106, 108 are moved to a fully mated position. More particularly, the abutment faces 126, 140 of the wedge portions 120, 134 are moved in sliding contact with one another in the directions of arrows C and D as shown in FIG. 8 until the wiping contact surfaces 128, 142 are brought into engagement, and the wedge portions 120, 124 may then be moved transversely into a nested or interfitted relationship as shown in FIG. 9 with the wiping contact surfaces 128, 132 in sliding engagement. All the while, the fastener 110 self adjusts its angular position with respect to the fastener bores as the fastener 110 moves from the initial position shown in FIG. 8 to a final position shown in FIG. 9. In the final, mated position, the fastener 110 extends obliquely to each of the fastener bores 124, 138, and the nut 112 may be tightened to the fastener 110 to secure the connector members 106, 108 to one another.

The channels 132A, 132B, 146A and 146B define respective channel longitudinal axes H-H, I-I, J-J and K-K that are spaced apart from one another (FIG. 8). The channel axes H-H, I-I, J-J and K-K correspond to the longitudinal or lengthwise axes of the portions of the elongate conductors 12, 14 when the conductors are installed in the channels 132A, 132B, 146A, 146B, 166, 176. According to some embodiments and as shown, the channel axes H-H, I-I, J-J and K-K are substantially parallel to one another. The connector assembly 100 is configured such that rotation of the fastener 110 translates the connector members 106, 108 relative to one another along a translation axis M-M (FIG. 8). The translation axis M-M is transverse to the channel axes H-H, I-I, J-J and K-K. According to some embodiments and as shown, the translation axis M-M is substantially perpendicular to the channel axes H-H, I-I, J-J and K-K and, thereby, the lengthwise axes of the installed conductors.

FIG. 9 illustrates the connector assembly 100 in a fully mated position with the nut 112 tightened to the fastener 110. In the fully mated position, the connector members 106, 108 cooperate to capture the conductors 12, 14. The conductor 12 is positioned within, and cradled by, the channel 166 of the insert member 160. The conductor 12 also engages, and makes direct electrical contact with, the conductor contact surface 144 of the second connector member 108.

Similarly, the conductor 14 is positioned within, and cradled by, the channel 146A of the connector member 108. The conductor 14 also engages, and makes direct electrical contact with, the conductor contact surface 130 of the connector member 106.

During assembly, as the connector members 106, 108 are moved through the positions shown in FIGS. 8 and 9, the wiping contact surfaces 128, 142 slidably engage one another and provide a wiping contact interface that ensures adequate electrically connectivity. The angled wiping contact surfaces 128, 142 provide a ramped contact interface that displaces the conductor contact surfaces 130, 144 in opposite directions indicated by arrows A and B (FIG. 8) as the wiping contact surfaces 128, 142 are engaged. In addition, the conductor contact surfaces 130, 144 provide wiping contact interfaces with the conductors 12 and 14 as the connector assembly 100 is installed.

Movement of the conductor contact surfaces 130, 144 in the opposite directions of arrows A and B clamps the conductors 12 and 14 between the wedge portions 120, 134 and the opposing channel portions 122, 136. The mating interfaces 131, 145 of the channel portions 122, 136 are brought toward the wedge portions 120, 134 to the mated position, such as the position shown in FIG. 9. In the mated position, the connector members 106, 108 substantially enclose portions of the conductors 12, 14 within the connector assembly 100. More particularly, the channels 166 and 146A and the conductor contact surfaces 144 and 130 define respective conductor passageways 192, 194 through which the conductors 12, 14 extend.

According to some embodiments, the abutment faces 126, 140 of the wedge portions 120, 134 contact the displacement stops 125, 139 of the opposing connector members 108 and 106 when the connector assembly 100 is fully mated. In such a position, the wedge portions 120, 134 are nested or mated with one another in an interfitting relationship with the wiping contact surfaces 128 and 142 and the abutment faces 126 and 140, providing multiple points of mechanical and electrical contact to ensure electrical connectivity between the connector members 106 and 108.

In the fully mated position, such as the position shown in FIG. 9, the conductor 14 is captured in the channel 146A between the channel portion 136 of the second connector member 108 and the conductor contact surface 130 of the first connector member wedge portion 120. Likewise, the conductor 12 is captured in the channel 166 between the channel portion 122 of the first connector member 106 and the conductor contact surface 144 of the second connector member wedge portion 134. As the wedge portion 120 engages the first connector member 106 and clamps the main conductor 14 against the channel portion 136 of the second connector member 108, the channel portion 136 is deflected in the direction of arrow E (FIG. 9). Likewise, the wedge portion 134 of the second connector member 108 clamps the conductor 12 against the channel portion 122 of first connector member 106 and the channel portion 122 is deflected in the direction of arrow G (FIG. 9). The channel portions 122, 136 are elastically deflected in radial directions indicated by the arrows E, G, resulting in a spring back force in the opposite directions to provide a clamping force on the conductors 12, 14.

The amount of deflection, and the amount of clamping force, may be affected by the thicknesses of the channel portions 122, 136, the thicknesses of the insert members 160, 170, the lengths of the channel portions 122, 136, the type of material of the connector members 106, 108, and the like. A large contact force, on the order of about 4000 lbs is provided in an exemplary embodiment, and the clamping force ensures adequate electrical connectivity between the conductors 12, 14 and the connector assembly 100. Additionally, elastic spring back of the channel portions 122, 136 provides some tolerance for deformation or compressibility of the conductors 12, 14 over time, because the channel portions 122, 136 may effectively return if the conductors 12, 14 deform due to compression forces. Actual clamping forces may be lessened in such a condition, but not to such an amount as to compromise the integrity of the electrical connection. In an exemplary embodiment, the spring back allows a range of tolerance within the elastic range of the channel portions 122, 136.

Figure 10:
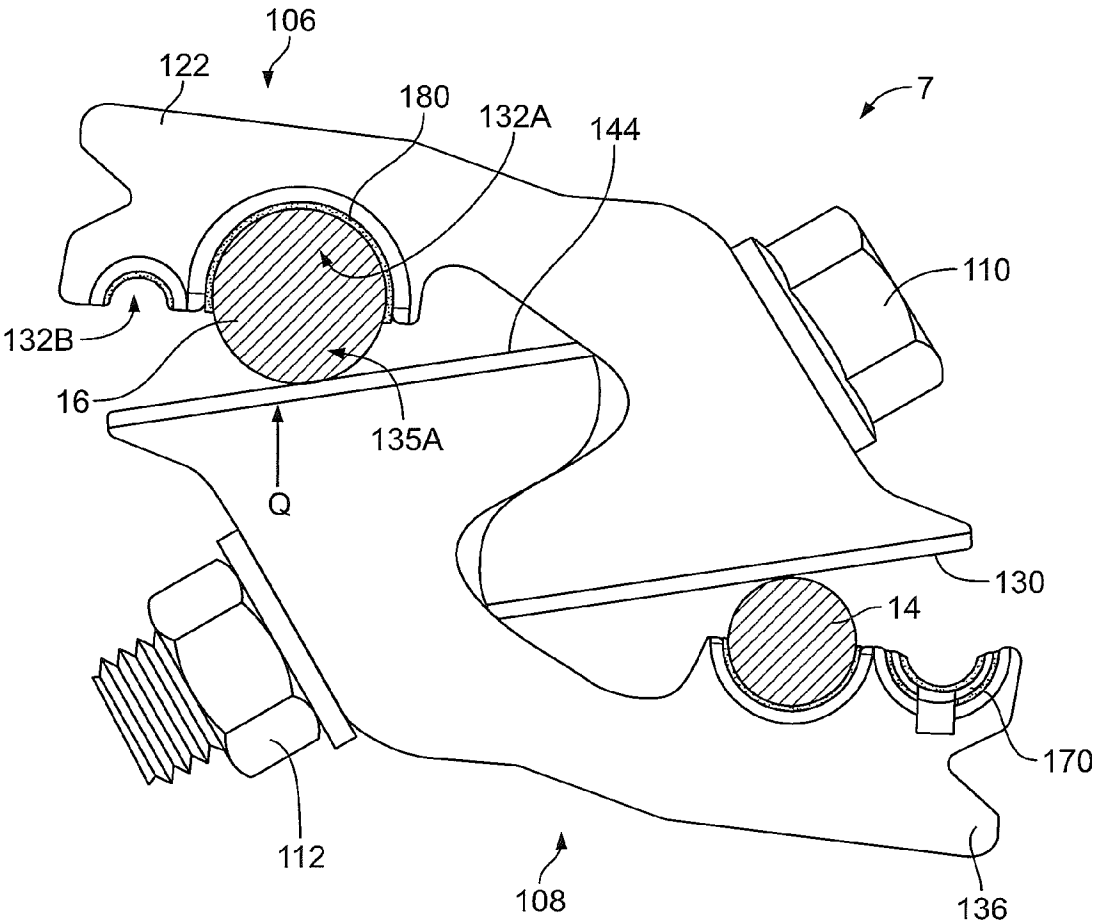
FIG. 10 is a side view of the connector assembly of FIG. 1 fully installed on a pair of elongate electrical conductors in an alternate configuration.

While a particular configuration of the connector assembly 100 and the conductors 12, 14 is shown in FIG. 9 and described above, other configurations may be employed as desired. The installer may elect to install the conductor 12 in the channel 132B and/or to install the conductor 14 in the channel 176. Moreover, the installer can remove one or both of the insert members 160, 170 and install the conductors 12, 14 in the larger channels 132A, 146B. For example, FIG. 10 illustrates a configuration wherein the installer has removed the insert member 160 and installed an elongate electrical conductor 16, which is somewhat greater in diameter than the conductor 12, in the channel 132A to form a connection 7. It will be appreciated that the configurations illustrated in FIGS. 9 and 10 are not exhaustive, and many more permutations of configurations are possible by suitably selecting from the multiple channels 132A, 132B, 166, 146A, 146B, 176 (including suitably retaining the insert members 160, 170 in the channels 132A, 146B or removing the insert members 160, 170 therefrom). For example, the installer may remove both of the insert members 160, 170 and install elongate conductors in each of the channels 132A and 146B.

In some embodiments, a connector system may be provided including a plurality of first connector assemblies 107 (i.e., a connector member 106 with an insert member 160 mounted in the channel 132A) and a plurality of second connector member assemblies 109 (i.e., a connector member 108 with an insert member 170 mounted in the channel 146B). The installer can then selectively pair two assemblies 107, 109 as needed to form a connector assembly of a desired configuration. For example, the installer can construct a connector assembly 100 comprising an assembly 107 and an assembly 109 (as shown in FIGS. 1-9), a connector assembly comprising two assemblies 107, or a connector assembly comprising two assemblies 109 to enable even more permutations of connector assembly configurations.

According to still further embodiments, a connector system according to embodiments of the invention may include additional or alternative connector member assemblies for assembling into connector assemblies. For example, connector member assemblies may be provided including insert members 160, 170 pre-installed in both channels (e.g., 132A and 132B or 146A and 146B) of the connector member 106, 108. Connector members of other configurations may be provided. For example, the connector members 106, 108 may be modified to include more or fewer than two integral channels 132A, 132B or 146A, 146B, for example.

According to further embodiments, some or all of the insert members 160, 170 may not be pre-installed in the connector member channels 132A, 132B, 146A, 146B. Instead, a connector system according to embodiments of the invention may include a plurality of insert members 160, 170 that can be selectively installed in the channels 132A, 132B, 146A, 146B when the installer wishes to install the conductors 12, 14 in the channels 166, 176.

The connector members may have different sizes of channels defined in their channel portions. For example, as illustrated, the channel 132A of the connector member 106 is sized differently than the channel 146A of the connector member 108, and the channel 132B is sized differently than the channel 146B. Connector members with integral channels of still further sizes and combinations of sizes may be provided in the connector system to provide the installer with further configurations of connector assemblies to accommodate elongate conductors of different sizes.

As shown and described, the connector system includes insert members 160, 170 of different configurations to fit in channels 132A, 146A of different sizes. The connector system may also include insert members each sized to be seated in a given channel portion channel but having different channel sizes. For example, the connector system may include, in addition to the insert members 160, an insert member mounted in or configured to be mounted in a channel 132A of a connector member 106 but having a different (e.g., shallower) depth than the channel 166.

With reference to FIGS. 8-10, according to some embodiments, one or more of the elongate conductors 12, 14, 16 are inserted into their selected channels in an insertion direction that is transverse to the longitudinal axis H-H, I-I, J-J, K-K (FIG. 8) of the channel. For example, the conductor 12 may be inserted into the insert member channel 166 through the side opening 168A (FIGS. 5 and 9) in an insertion direction P (FIG. 9) that is transverse to the channel longitudinal axis H-H (FIG. 8). According to some embodiments and as illustrated, the insertion direction P is substantially perpendicular to the channel longitudinal axis H-H. By way of further example, the conductor 16 may be inserted into the channel 132A through the side opening 135A (FIGS. 2 and 10) in an insertion direction Q (FIG. 10) that is transverse to (and, according to some embodiments, substantially perpendicular to) the channel longitudinal axis H-H. The conductor 12 or 16 may thereafter be clamped in the channel 166, 132A as described above. By permitting sideward or transverse insertion of the elongate conductors into the selected channels, the connector systems and methods as described enable an installer to conveniently and effectively mount the connector assembly to midpoints or midsections of an elongate conductor or conductors having terminal ends that cannot be easily accessed or freed, for example.

According to some embodiments, torque requirements for tightening of the fastener 110 are not required to satisfactorily install the connector assembly 100. When the abutment faces 126, 140 of the wedge portions 120, 134 contact the channel portions 136, 122, the connector assembly 100 is fully mated. By virtue of the fastener elements 110, 112 and the combined wedge action of the wedge portions 120, 134 to deflect the channel portions 122, 136, the connector assembly 100 may be installed with hand tools, and specialized tooling, such as the explosive cartridge tooling of the AMPACT Connector system is avoided.

When fully mated, the abutment faces 126 and 140 may engage the displacement stops 139, 125, respectively, which define and limit a final displacement relation between the connector members 106, 108. The displacement stops 125, 139 define a final mating position between the connector members 106 and 108 independent of an amount of force induced upon the conductors 14, 12 by the main and first connector members 108 and 106. In an alternative embodiment, the abutment faces 126, 130 may be positioned a distance from the displacement stops 125, 139 in the final mating position.

Optionally, the displacement stops 125, 139 may be created from a stand off provided on one or both of the connector members 108 and 106. For example, the stand off may be positioned proximate the central body portion 116 and extend outward therefrom. The stand off provides a gap between the channel portions 122, 136 and the wedge portions 134, 120, respectively, which allows the channel portions 122, 136 to flex and/or move without engaging the abutment faces 140, 126 of the respective wedge portions 134, 120. Alternatively, the displacement stops 125, 139 may be created as mating notches provided in the wiping contact surfaces 128 and 142, where the notches engage one another to limit a range of travel of the main and first connector members 108 and 106 toward one another.

The displacement stops 125, 139 allow the nut 112 and fastener 110 to be continuously tightened until the abutment faces 126, 140 fully seat against the channel portions 136, 122, independent of, and without regard for, any normal forces created by the tap and main conductors 12, 14. The contact forces are created by interference between the channel portions 136, 122, and wedge portions 120, 134, and conductors 12, 14. It is not necessary to measure the bolt torque in the mating the connector assembly 100 as the connector assembly 100 is fully mated when the connector members 106, 108 are joined to a predetermined position or relative displacement. In the fully mated condition, the interference between the conductors 12, 14 and the connector assembly 100 produces a contact force adequate to provide a good electrical connection.

It is recognized that effective clamping force on the conductors 12, 14 is dependent upon the geometry of the wedge portions, dimensions of the channel portions and the insert members, and size of the conductors used with the connector assembly 100. Thus, with strategic selections of angles for the wiping contact surfaces 128, 142 for example, the thicknesses and lengths of the channel portions 122, 136, respectively, and the size and positioning of the conductors 12, 14, varying degrees of clamping force may be realized when the connector members 106 and 108 are used in combination as described above.

Because of the plurality of channels 132A, 132B, 166, 146A, 146B, 176 within the channel portions 122, 136 and the insert members 160, 170, the connector member assemblies 107 and 109 may accommodate a greater range of conductor sizes or gauges in comparison to conventional connectors. Connector systems according to embodiments of the present invention may require a smaller inventory of parts in comparison to conventional bolt-on connectors and to conventional wedge connector systems, for example, to accommodate a full range of installations in the field. That is, a relatively small family of connector parts having similarly sized and shaped wedge portions may effectively replace a much larger family of parts known to conventional wedge connector systems.

While the above described embodiments have been described with respect to transverse wedge type connectors and parallel groove type connectors, it is realized that the invention may be practiced in other types of connectors, such as, but in no way limited to, vice connectors, clam-shell type connectors, wedge connectors including bolt driven wedge connectors and fired wedge connectors, compression connectors, and the like. The connectors may include one, two or even more components that are coupled together to securely interconnect the two conductors. The connector pieces may be joined by a bolted connection, or with another type of fastener, or the pieces may be coupled by other devices or methods, such as compression.

According to some embodiments, the radius of curvature of the channels 132A, 132B, 146A, 146B, 166, 176 is between about ⅛ and ¾ inch. According to some embodiments, each of the channels 132A, 132B, 146A, 146B, 166, 176 extends along an arc of between about 120 and 180 degrees.

According to some embodiments, the width of each planar conductor contact surface 130, 144 is between about 1 and 2 inches.

According to some embodiments, the ratio of the length L (FIG. 3) of each channel 132A, 132B, 146A, 146B, 166, 176 to the outer diameter of the conductor (e.g., conductor 12, 14 or 16) to be received is between about 2 and 25. According to some embodiments, the depth of the channels 132A, 132B, 146A, 146B, 166, 176 is between about ⅛ and 1.2 inches.

Alternative and additional features and configurations of transverse wedge connectors that may be modified in accordance with embodiments of the present invention are disclosed in U.S. Pat. Nos. 7,862,390, 7,845,990, 7,686,661, 7,677,933, 7,494,385, 7,387,546, 7,309,263, 7,182,653 and U.S. Patent Publication Nos. 2010/0015862 and 2010/0011571, the disclosures of which are incorporated herein by reference.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A transverse wedge connector system for forming an electrical connection with first and second elongate electrical conductors, the transverse wedge connector system comprising:

an electrically conductive first connector member including:

a first body having a first channel portion and a first abutment portion, the first channel portion defining a first channel to receive the first conductor; and an electrically conductive second connector member including:

a second body having a second channel portion and a second abutment portion, the second channel portion defining a second channel to receive the second conductor;

an insert member configured to be selectively mounted in the first channel and defining an insert member channel to receive the first conductor when the insert member is mounted in the first channel; and a clamping mechanism selectively operable to displace the first and second connector members relative to one another from an open position to a closed position to clamp the first conductor between the first channel portion and the second abutment portion, and to clamp the second conductor between the second channel portion and the first abutment portion to thereby form a connection;

wherein the insert member is electrically conductive.

2. The transverse wedge connector system of claim 1 wherein the insert member is factory pre-installed in the first channel and removable therefrom to permit the first conductor to be placed in the first channel.

3. The transverse wedge connector system of claim 1 wherein the insert member includes integral tabs securing the insert member in the first channel.

4. The transverse wedge connector system of claim 1 wherein:

the first connector member includes a first contact surface defining the first channel;

the insert member includes an insert member contact surface defining the insert member channel; and the transverse wedge connector system further includes layers of a viscous corrosion inhibitor coating each of the first contact surface and the insert member contact surface.

5. The transverse wedge connector system of claim 1 wherein:

the first channel defines a first channel longitudinal axis;

the insert member channel defines an insert member channel longitudinal axis;

the first channel has a longitudinally extending side opening that permits insertion of the first conductor into the first channel in a direction transverse to the first channel longitudinal axis; and the insert member channel has a longitudinally extending side opening that permits insertion of the first conductor into the insert member channel in an insertion direction transverse to the insert member channel longitudinal axis.

6. The transverse wedge connector system of claim 1 wherein the first channel and the insert member channel are of different sizes from one another.

7. The transverse wedge connector system of claim 1 wherein the first channel is deeper than the insert member channel.

8. The transverse wedge connector system of claim 1 including a second insert member configured to be selectively mounted in the second channel and defining a second insert member channel to receive the second conductor when the second insert member is mounted in the second channel.

9. The transverse wedge connector system of claim 1 wherein the first channel portion further defines a third channel to alternatively receive the first conductor, wherein the first channel, the insert member channel and the third channel each have a different size from one another.

10. The transverse wedge connector system of claim 1 wherein:

the first connector member includes a first wedge portion from which the first channel portion extends;

the second connector member includes a second wedge portion from which the second channel portion extends; and when the first and second connector members are in the closed position, the first and second wedge members are nested with one another and the first and second channel portions are elastically deflected with respect to the first and second wedge portions, respectively.

11. The transverse wedge connector system of claim 1 wherein:

the first and second channels define first and second channel longitudinal axes, respectively;

the clamping mechanism is operable to move the first and second connector members together along a translation axis to move from the open position to the closed position; and the translation axis is transverse to the first and second channel longitudinal axes.

12. A method for forming a connection including first and second elongate electrical conductors, the method comprising:

providing a transverse wedge connector system including:

an electrically conductive first connector member including:

a first body having a first channel portion and a first abutment portion, the first channel portion defining a first channel to receive the first conductor; and an electrically conductive second connector member including:

a second body having a second channel portion and a second abutment portion, the second channel portion defining a second channel to receive the second conductor;

an insert member configured to be selectively mounted in the first channel and defining an insert member channel to receive the first conductor when the insert member is mounted in the first channel; and a clamping mechanism;

with the first and second connector members in an open position, placing the first conductor in the first channel or, alternatively, in the insert member channel with the insert member mounted in the first channel; and thereafter selectively operating the clamping mechanism to displace the first and second connector members relative to one another from the open position to a closed position to clamp the first conductor between the first channel portion and the second abutment portion, and to clamp the second conductor between the second channel portion and the first abutment portion to thereby form a connection wherein the insert member is electrically conductive.

13. The method of claim 12 including:

with the insert member mounted in the first channel and the first and second connector members in the open position, placing the first conductor in the insert member channel; and thereafter selectively operating the clamping mechanism to displace the first and second connector members relative to one another from the open position to a closed position to clamp the first conductor in the insert member channel between the first channel portion and the second abutment portion, and to clamp the second conductor between the second channel portion and the first abutment portion to thereby form the connection.

14. The method of claim 13 including mounting the insert member in the first channel prior to the step of placing the first conductor in the insert member channel.

15. The method of claim 13 wherein the insert member is factory pre-mounted in the first channel.

16. The method of claim 12 including:

removing the insert member from the first channel; thereafter with the first and second connector members in an open position, placing the first conductor in the first channel; and thereafter selectively operating the clamping mechanism to displace the first and second connector members relative to one another from the open position to a closed position to clamp the first conductor in the first channel between the first channel portion and the second abutment portion, and to clamp the second conductor between the second channel portion and the first abutment portion to thereby form a connection.

17. The method of claim 12 wherein:

the first channel defines a first channel longitudinal axis;

the insert member channel defines an insert member channel longitudinal axis;

the first channel has a longitudinally extending side opening;

the insert member channel has a longitudinally extending side opening;

placing the first conductor in the first channel includes inserting the first conductor into the first channel through the side opening of the first channel in a direction transverse to the first channel longitudinal axis; and placing the first conductor in the insert member channel with the insert member mounted in the first channel includes inserting the first conductor into the insert member channel through the side opening of the insert member channel in a direction transverse to the insert member channel longitudinal axis.

18. The method of claim 12 wherein the first channel and the insert member channel are of different sizes from one another, the method including:

determining the size of the first conductor;

selecting which of the first channel and the insert member channel is of a size corresponding to the determined size of the first conductor;

placing the first conductor in the selected one of the first channel and the insert member channel; and selectively operating the clamping mechanism to displace the first and second connector members relative to one another from the open position to a closed position to clamp the first conductor in the selected one of the first channel and the insert member channel to thereby form the connection.

19. A connector system for forming an electrical connection with an elongate electrical conductor, the connector system comprising:

an electrically conductive connector member including a body having a channel portion defining a first channel to receive the conductor;

an insert member configured to be selectively mounted in the first channel and defining an insert member channel to receive the conductor when the insert member is mounted in the first channel; and a clamping mechanism selectively operable to secure the conductor in the first channel or in the insert member channel to thereby form a connection;

wherein:

the first channel defines a first channel longitudinal axis;

the insert member channel defines an insert member channel longitudinal axis;

the first channel has a longitudinally extending side opening that permits insertion of the first conductor into the first channel in an insertion direction transverse to the first channel longitudinal axis; and the insert member channel has a longitudinally extending side opening that permits insertion of the first conductor into the insert member channel in an insertion direction transverse to the insert member channel longitudinal axis, and the insert member is electrically conductive.

20. A transverse wedge connector system for forming an electrical connection with first and second elongate electrical conductors, the transverse wedge connector system comprising:

an electrically conductive first connector member including:

a first body having a first channel portion and a first abutment portion, the first channel portion defining a first channel to receive the first conductor; and an electrically conductive second connector member including:

a second body having a second channel portion and a second abutment portion, the second channel portion defining a second channel to receive the second conductor;

an insert member configured to be selectively mounted in the first channel and defining an insert member channel to receive the first conductor when the insert member is mounted in the first channel; and a clamping mechanism selectively operable to displace the first and second connector members relative to one another from an open position to a closed position to clamp the first conductor between the first channel portion and the second abutment portion, and to clamp the second conductor between the second channel portion and the first abutment portion to thereby form a connection;

wherein:

the first channel defines a first channel longitudinal axis;

the insert member channel defines an insert member channel longitudinal axis;

the first channel has a longitudinally extending side opening that permits insertion of the first conductor into the first channel in a direction transverse to the first channel longitudinal axis; and the insert member channel has a longitudinally extending side opening that permits insertion of the first conductor into the insert member channel in an insertion direction transverse to the insert member channel longitudinal axis.

21. A transverse wedge connector system for forming an electrical connection with first and second elongate electrical conductors, the transverse wedge connector system comprising:

an electrically conductive first connector member including:

a first body having a first channel portion and a first abutment portion, the first channel portion defining a first channel to receive the first conductor; and an electrically conductive second connector member including:

a second body having a second channel portion and a second abutment portion, the second channel portion defining a second channel to receive the second conductor;

an insert member configured to be selectively mounted in the first channel and defining an insert member channel to receive the first conductor when the insert member is mounted in the first channel; and a clamping mechanism selectively operable to displace the first and second connector members relative to one another from an open position to a closed position to clamp the first conductor between the first channel portion and the second abutment portion, and to clamp the second conductor between the second channel portion and the first abutment portion to thereby form a connection;

wherein:

the first connector member includes a first wedge portion from which the first channel portion extends;

the second connector member includes a second wedge portion from which the second channel portion extends; and when the first and second connector members are in the closed position, the first and second wedge members are nested with one another and the first and second channel portions are elastically deflected with respect to the first and second wedge portions, respectively.

* * * * *